US009032722B2

(12) United States Patent
Kawasaki et al.

(10) Patent No.: US 9,032,722 B2
(45) Date of Patent: May 19, 2015

(54) HYBRID OPERATING MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 521 days.

(21) Appl. No.: 13/512,850

(22) PCT Filed: Apr. 22, 2011

(86) PCT No.: PCT/JP2011/059967

§ 371 (c)(1),
(2), (4) Date: May 30, 2012

(87) PCT Pub. No.: WO2011/145432

PCT Pub. Date: Nov. 24, 2011

(65) Prior Publication Data

US 2012/0233995 A1 Sep. 20, 2012

(30) Foreign Application Priority Data

May 20, 2010 (JP) ..... 2010-116604

(51) Int. Cl.

| | |
|---|---|
| ***F16D 31/02*** | (2006.01) |
| ***E02F 9/22*** | (2006.01) |
| ***E02F 9/20*** | (2006.01) |

(52) U.S. Cl.

CPC ..... *E02F 9/2217* (2013.01); *E02F 9/2075* (2013.01); *E02F 9/2235* (2013.01); *E02F 9/2282* (2013.01); *E02F 9/2285* (2013.01); *E02F 9/2292* (2013.01); *E02F 9/2296* (2013.01); *F15B 2211/20515* (2013.01); *F15B 2211/20523* (2013.01); *F15B 2211/20576* (2013.01); *F15B 2211/265* (2013.01); *F15B 2211/88* (2013.01)

(58) Field of Classification Search

CPC ..... F15B 2211/7142; E02F 9/2296; E02F 9/2282; E02F 9/2235; F04B 49/00

USPC ..... 60/421, 429, 430, 445

See application file for complete search history.

(56) References Cited

U.S. PATENT DOCUMENTS

2011/0071738 A1 3/2011 Kawasaki et al.

FOREIGN PATENT DOCUMENTS

| | | | |
|---|---|---|---|
| DE | 11 2009 000 767 | T5 | 2/2011 |
| JP | 2005-012900 | A | 1/2005 |
| JP | 2007-327527 | A | 12/2007 |
| JP | 2009-235717 | A | 10/2009 |
| JP | 2009-236190 | A | 10/2009 |
| JP | 2009-236191 | A | 10/2009 |

*Primary Examiner* — Edward Look
*Assistant Examiner* — Jason Mikus
(74) *Attorney, Agent, or Firm* — Rabin & Berdo, P.C.

(57) ABSTRACT

A controller determines whether or not a control valve for controlling the supply of pressure fluid from a main pump to an actuator is at a neutral position, detects input power of a hydraulic motor rotated by return oil from the actuator, and narrows the opening of a proportional electromagnetic throttle valve when the control valve is at the neutral position and the input power of the hydraulic motor is in excess of a first threshold value.

6 Claims, 3 Drawing Sheets

HYBRID OPERATING MACHINE

TECHNICAL FIELD

This invention relates to a hybrid operating machine utilizing a regeneration flow rate from an actuator.

BACKGROUND ART

JP2009-236190A discloses a hybrid operating machine utilizing a regeneration flow rate from an actuator. In this hybrid operating machine, an on-off valve is provided between a boom cylinder as the actuator and a hydraulic motor for regeneration. The on-off valve is kept at a closed position when a control valve for controlling the actuator is returned to a neutral position.

In the case of suddenly stopping the boom cylinder operating at a high speed while a high load is acting thereon, the on-off valve is switched to the closed position at the same time as the control valve is switched to the neutral position, thereby preventing runaway of the boom cylinder and preventing a high torque equal to or higher than absorption capacity of a motor generator from being input from the hydraulic motor to the motor generator. This prevents a high torque equal to or higher than the absorption capacity of the motor generator from acting on the motor generator to cause a failure or runaway of the motor generator.

SUMMARY OF INVENTION

However, in the above conventional hybrid operating machine, a high torque equal to or higher than the absorption capacity of the motor generator may possibly act on the motor generator in the case of suddenly returning the control valve to the neutral position to suddenly stop the actuator. This is because there is a limit to responsiveness of the on-off valve and it is difficult to suddenly stop the actuator by instantaneously closing the on-off valve.

It may be thought to enlarge the motor generator to increase the absorption capacity of the motor generator, but it leads to a cost increase due to the enlargement.

An object of this invention is to enable an actuator to reliably stop and prevent a high torque equal to or higher than absorption capacity from acting on a motor generator in the case of suddenly stopping the actuator operating at a high speed while a high load is acting thereon in a hybrid operating machine.

According to a certain aspect of the present invention, a hybrid operating machine is provided which includes a main pump; an engine which drives the main pump; a variable-capacity assist pump connected to a discharge side of the main pump via a joint passage; a tilting angle controller which controls a tilting angle of the assist pump; a proportional electromagnetic throttle valve provided in the joint passage; an actuator; a control valve which controls the supply of pressure fluid from the main pump to the actuator; a variable-capacity hydraulic motor which is rotated by return oil from the actuator; a motor generator connected to the assist pump and the hydraulic motor; a battery connected to the motor generator; and a controller which is connected to the tilting angle controller and the proportional electromagnetic throttle valve, determines whether or not the control valve is at a neutral position, detects input power of the hydraulic motor rotated by the return oil from the actuator and narrows the opening of the proportional electromagnetic throttle valve when the control valve is at the neutral position and the input power of the hydraulic motor is in excess of a first threshold value.

According to the above aspect, when the input power of the hydraulic motor is in excess of the first threshold value, the input of power equal to or more than absorption capacity of the motor generator can be prevented since the input power of the hydraulic motor is absorbed by the assist pump.

Thus, even without improving responsiveness of an on-off valve or enlarging the motor generator more than necessary, the actuator can be reliably stopped without a high torque equal to or higher than the absorption capacity acting on the motor generator when the actuator operating at a high speed while a high load is acting thereon is suddenly stopped.

Embodiments of the present invention and advantages thereof are described in detail below with reference to the accompanying drawings.

EMBODIMENTS OF INVENTION

Figure 1:
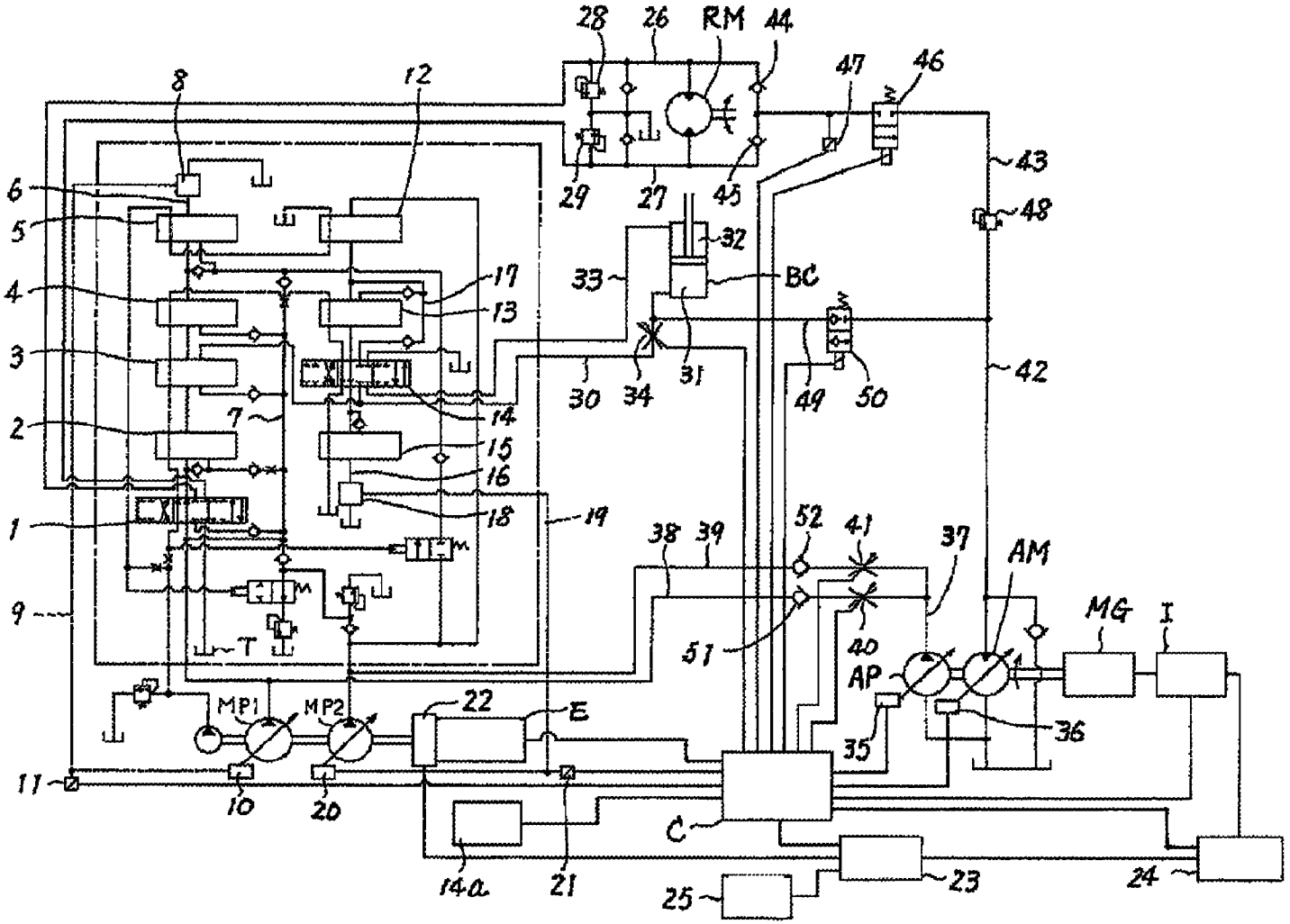
FIG. 1 is a circuit diagram of a power shovel according to an embodiment of the present invention.

FIG. 1 is a circuit diagram of a power shovel according to an embodiment of the present invention. The power shovel includes variable-capacity first and second main pumps MP1, MP2. A first circuit system is connected to the first main pump MP1. A second circuit system is connected to the second main pump MP2.

To the first circuit system are connected a control valve 1 for controlling a rotation motor RM, a control valve 2 for arm first speed for controlling an arm cylinder, a control valve 3 for boom second speed for controlling a boom cylinder BC, a control valve 4 for controlling an auxiliary attachment and a control valve 5 for controlling a left travel motor in this order from an upstream side.

The respective control valves 1 to 5 are connected to the first main pump MP1 via a neutral flow path 6 and a parallel passage 7.

A pilot pressure generating mechanism 8 is provided downstream of the control valve 5 in the neutral flow path 6. The pilot pressure generating mechanism 8 generates a high pilot pressure if a flow rate therethrough is high while generating a low pilot pressure if the flow rate is low.

The neutral flow path 6 introduces all or part of fluid discharged from the first main pump MP1 to a tank T when all the control valves 1 to 5 are at or near neutral positions. In this case, a high pilot pressure is generated since the flow rate through the pilot pressure generating mechanism 8 is also high.

If the control valves 1 to 5 are switched to full-stroke states, the neutral flow path 6 is closed and fluid does not flow any longer. In this case, the flow rate through the pilot pressure generating mechanism 8 is almost zero and the pilot pressure is kept at zero.

However, depending on the operated amounts of the control valves 1 to 5, part of pump-discharged oil is introduced to an actuator and part thereof is introduced to the tank T from the neutral flow path 6. Thus, the pilot pressure generating mechanism 8 generates a pilot pressure corresponding to the flow rate in the neutral flow path 6. That is, the pilot pressure generating mechanism 8 generates the pilot pressure corresponding to the operated amounts of the control valves 1 to 5.

A pilot flow path 9 is connected to the pilot pressure generating mechanism 8. The pilot flow path 9 is connected to a regulator 10 for controlling a tilting angle of the first main pump MP1. The regulator 10 controls the discharge amount of the first main pump MP1 in inverse proportion to a pilot pressure. Accordingly, the discharge amount of the first main pump MP1 is kept maximum when the control valves 1 to 5 are set to the full stroke states so that the flow in the neutral flow path 6 becomes zero, in other words, when the pilot pressure generated by the pilot pressure generating mechanism 8 becomes zero.

A first pressure sensor 11 is connected to the pilot flow path 9. A pressure signal of the first pressure sensor 11 is input to a controller C.

To the second circuit system are connected a control valve 12 for controlling a right travel motor, a control valve 13 for controlling a bucket cylinder, a control valve 14 for boom first speed for controlling the boom cylinder BC, and a control valve 15 for arm second speed for controlling the arm cylinder in this order from an upstream side. A sensor 14*a* for detecting an operating direction and an operated amount is provided in the control valve 14.

The respective control valves 12 to 15 are connected to the second main pump MP2 via a neutral flow path 16. The control valves 13 and 14 are connected to the second main pump MP2 via a parallel passage 17.

A pilot pressure generating mechanism 18 is provided downstream of the control valve 15 in the neutral flow path 16. The pilot pressure generating mechanism 18 functions in just the same manner as the pilot pressure generating mechanism 8 described above.

A pilot flow path 19 is connected to the pilot pressure generating mechanism 18. The pilot flow path 19 is connected to a regulator 20 for controlling a tilting angle of the second main pump MP2. The regulator 20 controls the discharge amount of the second main pump MP2 in inverse proportion to a pilot pressure. The discharge amount of the second main pump MP2 is kept maximum when the control valves 12 to 15 are set to the full stroke states so that the flow in the neutral flow path 16 becomes zero, in other words, when the pilot pressure generated by the pilot pressure generating mechanism 18 becomes zero.

A second pressure sensor 21 is connected to the pilot flow path 19. A pressure signal of the second pressure sensor 21 is input to the controller C The first and second main pumps MP1, MP2 are coaxially rotated by a drive force of one engine E.

The engine E includes a generator 22. The generator 22 is rotated by excess power of the engine E to generate power. Power generated by the generator 22 is charged into a battery 24 via a battery charger 23.

The battery charger 23 can charge the battery 24 with power also when being connected to an ordinary household power supply 25. That is, the battery charger 23 can be also connected to another independent power supply.

Passages 26, 27 communicating with the rotation motor RM are connected to an actuator port of the control valve 1 connected to the first circuit system. Brake valves 28, 29 are respectively connected to the both passages 26, 27. When the control valve 1 is kept at the neutral position, the actuator port is closed and the rotation motor RM remains stopped.

If the control valve 1 is switched to either side, pressure fluid is supplied from either one of the passages, e.g. the passage 26 to rotate the rotation motor RM. Return fluid from the rotation motor RM is returned to the tank T via the passage 27.

When the rotation motor RM is driven, the brake valve 28 or 29 functions as a relief valve and the brake valves 28, 29 are opened to introduce fluid at a high-pressure side to a low-pressure side if pressures in the passages 26, 27 increase to set pressures or higher.

If the control valve 1 is returned to the neutral position while the rotation motor RM is being rotated, the actuator port of the control valve 1 is closed. Even if the actuator port of the control valve 1 is closed, the rotation motor RM continues to rotate due to inertial energy. By rotating due to inertial energy, the rotation motor RM functions as a pump. In this case, a closed circuit is formed by the passages 26, 27, the rotation motor RM and the brake valve 28 or 29, and the inertial energy is converted into thermal energy by the brake valve 28 or 29.

On the other hand, if the control valve 14 is switched to a right position in FIG. 1 from the neutral position, pressure fluid from the second main pump MP2 is supplied to a piston-side chamber 31 of the boom cylinder BC via a passage 30. Return fluid from a rod-side chamber 32 is returned to the tank T via a passage 33, whereby the boom cylinder BC extends.

If the control valve 14 is switched to the left in FIG. 1, pressure fluid from the second main pump MP2 is supplied to the rod-side chamber 32 of the boom cylinder BC via the passage 33. Return fluid from the piston-side chamber 31 is returned to the tank T via the passage 30, whereby the boom cylinder BC contracts. The control valve 3 is switched in association with the control valve 14.

A proportional electromagnetic valve 34, the opening of which is controlled by the controller C, is provided in the passage 30 connecting the piston-side chamber 31 of the boom cylinder BC and the control valve 14. The proportional electromagnetic valve 34 is kept at a fully open position in a normal state.

Next, a variable-capacity assist pump AP for assisting outputs of the first and second main pumps MP1, MP2 is described.

The assist pump AP is rotated by a drive force of a motor generator MG. A variable-capacity hydraulic motor AM is also coaxially rotated by the drive force of the motor generator MG. An inverter I is connected to the motor generator MG. The inverter I is connected to the controller C and the rotation speed of the motor generator MG and the like can be controlled by the controller C.

Titling angles of the assist pump AP and the hydraulic motor AM are controlled by tilting angle controllers 35, 36. The tilting angle controllers 35, 36 are controlled by output signals of the controller C.

A discharge passage 37 is connected to the assist pump AP. The discharge passage 37 is branched off to a first joint passage 38 which joins at a discharge side of the first main pump MP1 and a second joint passage 39 which joins at a discharge side of the second main pump MP2. First and second proportional electromagnetic throttle valves 40, 41, the openings of which are controlled by output signals of the controller C, are provided in the respective first and second joint passages 38, 39.

A connection passage 42 is connected to the hydraulic motor AM. The connection passage 42 is connected to the passages 26, 27 connected to the rotation motor RM via the joint passage 43 and check valves 44, 45. An electromagnetic on-off valve 46, the opening and closing of which are controlled by the controller C, is provided in the joint passage 43. A pressure sensor 47 for detecting a pressure at the time of rotating the rotation motor RM or a pressure at the time of braking is provided between the electromagnetic on-off valve 46 and the check valves 44, 45. A pressure signal of the pressure sensor 47 is input to the controller C.

In the joint passage 43, a safety valve 48 is provided at a position downstream of the electromagnetic on-off valve 46 with respect to a flow from the rotation motor RM to the connection passage 42. The safety valve 48 prevents runaway of the rotation motor RM caused by maintaining the pressures in the passages 26, 27, for example, when the electromagnetic on-off valve 46 or the like fails.

A passage 49 communicating with the connection passage 42 is provided between the boom cylinder BC and the proportional electromagnetic valve 34. An electromagnetic on-off valve 50 controlled by the controller C is provided in the passage 49.

Next, functions of this embodiment are described.

If the control valve 1 is switched to the neutral position during the rotation of the rotation motor RM, a closed circuit is formed between the passages 26 and 27 and the brake valve 28 or 29 maintains a brake pressure of the closed circuit to convert inertial energy into thermal energy.

The pressure sensor 47 detects a rotation pressure or a brake pressure. A pressure signal is input to the controller C. The controller C switches the electromagnetic on-off valve 46 in the case of detecting a pressure which is within such a range as not to affect the rotation of the rotation motor RM or a braking operation and lower than set pressures of the brake valves 28, 29. If the electromagnetic on-off valve 46 is switched, pressure fluid introduced to the rotation motor RM flows into the joint passage 43 and is supplied to the hydraulic motor AM via the safety valve 48 and the connection passage 42.

The controller C controls a tilting angle of the hydraulic motor AM in accordance with a pressure signal from the pressure sensor 47 as described below.

Unless the pressure in the passage 26 or 27 is kept at a pressure necessary for the rotating operation or the braking operation, it becomes impossible to rotate the rotation motor RM or apply braking.

Accordingly, to keep the pressure in the passage 26 or 27 at the above rotation pressure or the brake pressure, the controller C controls a load of the rotation motor RM by controlling the tilting angle of the hydraulic motor AM. Specifically, the controller C controls the tilting angle of the hydraulic motor AM so that the pressure detected by the pressure sensor 47 becomes substantially equal to the rotation pressure of the rotation motor RM or the brake pressure.

If the hydraulic motor AM obtains a rotational force, this rotational force acts on the coaxially rotating motor generator MG. The rotational force of the hydraulic motor AM acts as an assist force for the motor generator MG. Accordingly, power consumption of the motor generator MG can be reduced by the rotational force of the hydraulic motor AM.

The rotational force of the assist pump AP can also be assisted by the rotational force of the hydraulic motor AM.

Next, a case is described where the boom cylinder BC is controlled by switching the control valve 14 and the control valve 3 in association with the control valve 14.

If the control valve 14 and the control valve 3 associated therewith are switched to actuate the boom cylinder BC, an operating direction and an operated amount of the control valve 14 are detected by the sensor 14*a*. An operation signal is input to the controller C.

In accordance with the operation signal of the sensor 14*a*, the controller C determines whether an operator is trying to raise or lower the boom cylinder BC. If a signal for raising the boom cylinder BC is input to the controller C, the controller C keeps the proportional electromagnetic valve 34 in the normal state, in other words, keeps the proportional electromagnetic valve 34 at the fully open position. In this case, the controller C keeps the electromagnetic on-off valve 50 at the shown closed position and controls the rotation speed of the motor generator MG and the tilting angle of the assist pump AP to ensure a predetermined discharge amount from the assist pump AP.

If a signal for lowering the boom cylinder BC is input to the controller C from the sensor 14*a*, the controller C calculates a lowering speed of the boom cylinder BC required by the operator according to the operated amount of the control valve 14, closes the proportional electromagnetic valve 34 and switches the electromagnetic on-off valve 50 to an open position.

If the proportional electromagnetic valve 34 is closed and the electromagnetic on-off valve 50 is switched to the open position, all the return fluid of the boom cylinder BC is supplied to the hydraulic motor AM. However, if the flow rate consumed by the hydraulic motor AM is lower than a flow rate necessary to maintain the lowering speed required by the operator, the boom cylinder BC cannot maintain the lowering speed required by the operator. In this case, the controller C controls the opening of the proportional electromagnetic valve 34 to return a flow rate equal to or higher than that consumed by the hydraulic motor AM to the tank T based on the operated amount of the control valve 14, the tilting angle of the hydraulic motor AM, the rotation speed of the motor generator MG and the like and maintains the lowering speed of the boom cylinder BC required by the operator.

If fluid is supplied to the hydraulic motor AM, the hydraulic motor AM rotates. The rotational force of the hydraulic motor AM acts on the coaxially rotating motor generator MG. The rotational force of the hydraulic motor AM acts as an assist force for the motor generator MG. Accordingly, power consumption can be reduced by the rotational force of the hydraulic motor AM.

In the case of using the motor generator MG as a generator using the hydraulic motor AM as a drive source, a substantially no-load state is set by zeroing the tilting angle of the assist pump AP and the hydraulic motor AM maintains an output necessary to rotate the motor generator MG. This enables the motor generator MG to exhibit a power generation function utilizing the output of the hydraulic motor AM.

Check valves 51, 52 are provided downstream of the first and second proportional electromagnetic throttle valves 40, 41. The check valves 51, 52 allow only a flow from the assist pump AP to the first and second main pumps MP1, MP2.

The controller C constantly monitors the magnitude of input power (power at an entrance side) of the hydraulic motor AM. For example, the following three methods can be thought as a method for calculating the magnitude of power.

(1) Method for calculation using current×voltage as generated power of the motor generator.

(2) Method for calculating a flow rate from the tilting angle of the hydraulic motor AM and the rotation speed of the motor generator MG and multiplying this flow rate by an inlet pressure of the hydraulic motor AM.

(3) Method for estimating the tilting angle of the hydraulic motor AM by mathematical modeling of a dynamic characteristic of the hydraulic motor AM, calculating a flow rate from the rotation speed of the motor generator MG based on the tilting angle and multiplying the flow rate by the inlet pressure of the hydraulic motor AM.

Any calculation method other than the above three calculation methods may be used. Regardless of which method is adopted, the controller C monitors the input power of the hydraulic motor AM.

The controller C monitors the input power of the hydraulic motor AM and checks whether or not all the control valves 1 to 5, 12 to 15 are kept at the neutral positions based on signals from sensors provided in the control valves 1 to 5, 12 to 15.

For example, in the case of stopping the boom cylinder BC, the operator returns the control valves 3, 14 to the neutral positions. In this case, the controller C closes the electromagnetic on-off valve 50 based on the signals from the sensors.

In the case of suddenly stopping the boom cylinder BC, the electromagnetic on-off valve 50 has to be instantaneously closed at the same time as the control valves 3, 14 are returned to the neutral positions. However, there is a limit to responsiveness of the electromagnetic on-off valve 50 and a response delay occurs when the electromagnetic on-off valve 50 is closed.

If the boom cylinder BC is performing a high-load operation, large power at that time is input to the hydraulic motor AM when a response delay occurs at the electromagnetic on-off valve 50. The controller C calculates the input power at this time and determines whether or not the calculation result is in excess of a first threshold value $\epsilon 1$ set beforehand. Then, the controller C executes a control corresponding to a flow chart shown in FIG. 2 according to the determination result.

That is, when a hybrid control is started (Step S1), the controller C determines whether or not all the control valves 1 to 5, 12 to 15 are kept at the neutral positions (Step S2). If any one of the control valves 1 to 5, 12 to 15 is at a switch position other than the neutral position, the controller C outputs a command signal necessary for a normal hybrid control (Step S3).

If all the control valves 1 to 5, 12 to 15 are kept at the neutral positions, an input power PL of the hydraulic motor AM is calculated (Step S4) and whether or not the input power PL is larger than the first threshold value $\epsilon 1$ is determined (Step S5).

If the input power PL is smaller than the first threshold value $\epsilon 1$, the controller C determines that the present situation is not the one in which the boom cylinder BC is suddenly stopped, and returns to Step S3.

However, if the input power PL is larger than the first threshold value $\epsilon 1$, it is judged that the boom cylinder BC performing the high-load operation is being suddenly stopped and proceeds to Step S6.

In Step S6, the controller C controls the tilting angle controller 35 for the assist pump AP to increase the tilting angle of the assist pump AP and increase a displacement volume per rotation. Further, the controller C causes the openings of the first and second proportional electromagnetic throttle valves 40, 41 to be reduced. Accordingly, the displacement volume amount per rotation from the assist pump AP increases and this passes through the first and second proportional electromagnetic throttle valves 40, 41, wherefore a pressure loss increases and functions as a brake force for the hydraulic motor AM.

Whether or not all the control valves 1 to 5, 12 to 15 are at the neutral positions is determined in Step S2 for the following reason. For example, if any one of the control valves is kept at a switch position other than the neutral position, an actuator connected to this control valve is operating and a load of this actuator is acting on the assist pump AP. Accordingly, the input power of the hydraulic motor AM can be absorbed by the load acting on the assist pump AP also in the case of suddenly stopping the boom cylinder BC. Thus, the control shown in Step S6 is executed only when all the control valves 1 to 5, 12 to 15 are at the neutral positions.

Thus, for example, in the case of a crane, one control valve suffices for an extension and contraction control and, hence, it is sufficient to determine whether or not this control valve is at a neutral position.

In the above embodiment, a control for the tilting angle of the assist pump AP and a control for the openings of the first and second proportional electromagnetic throttle valves 40, 41 are simultaneously executed. However, the openings of the proportional electromagnetic throttle valves 40, 41 may be controlled while the tilting angle of the assist pump AP is maintained to some extent.

Figure 2:
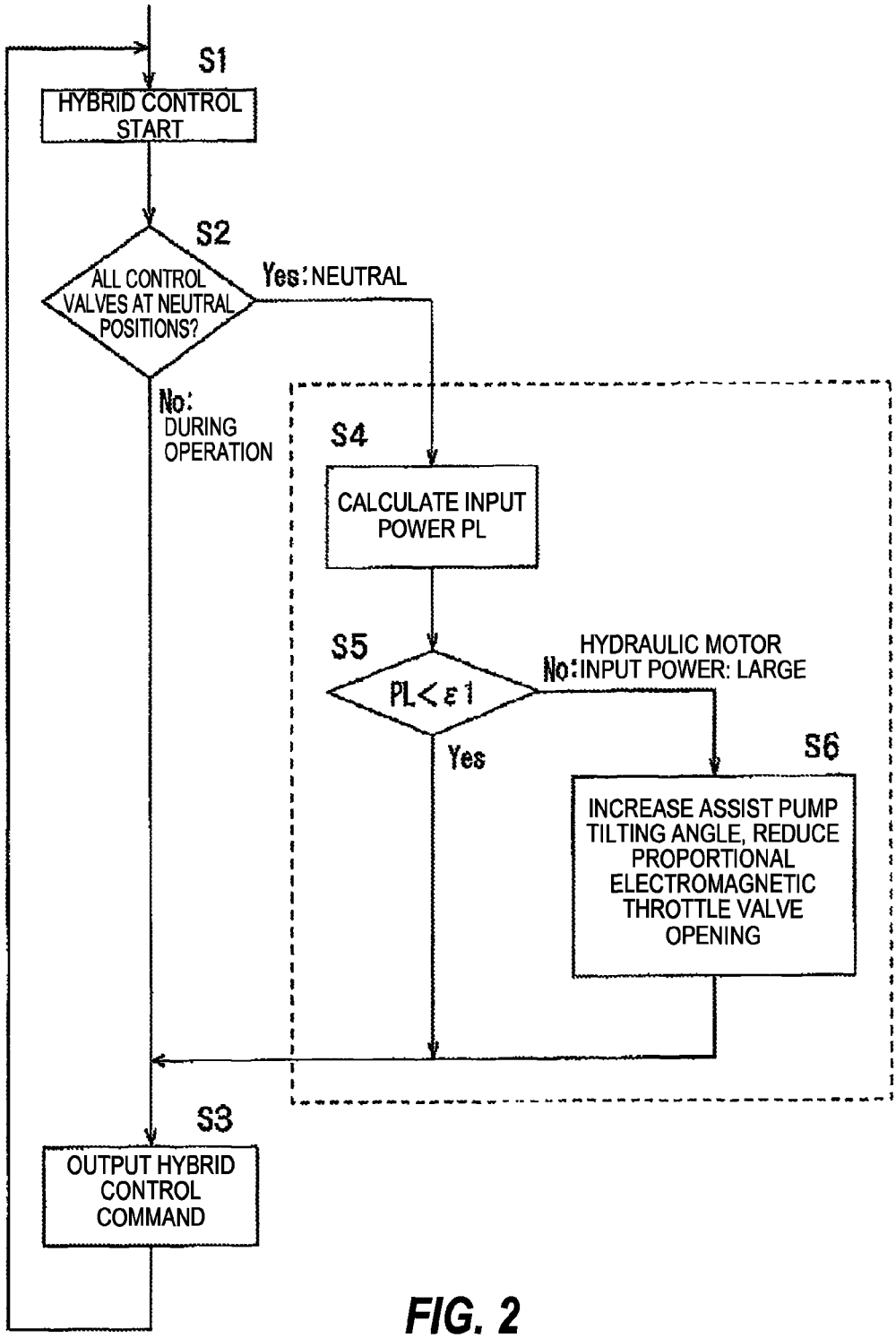
FIG. 2 is a flow chart showing a first control flow.

Even if the input power PL of the hydraulic motor AM is smaller than the first threshold value $\epsilon 1$ in Step S5 shown in FIG. 2, it can be determined that the boom cylinder BC is in an abnormal state if the input power PL is not reduced to a sufficiently small level even after the elapse of a time t1.

Figure 3:
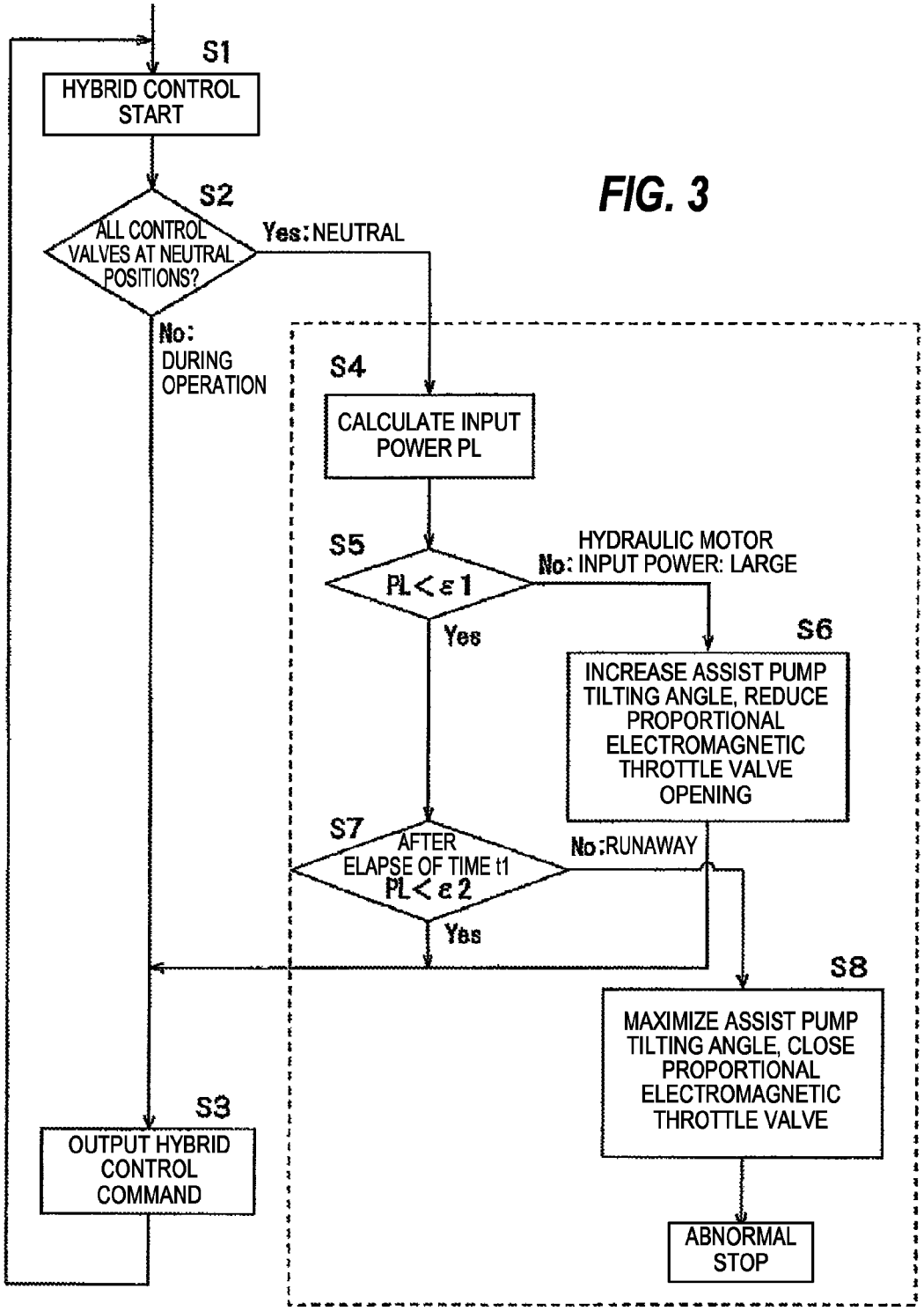
FIG. 3 is a flow chart showing a second control flow.

In this case, the boom cylinder BC can be reliably stopped by executing a control based on a flow chart shown in FIG. 3.

In the control mode shown in FIG. 3, Steps S1 to S6 are the same as in the case of FIG. 2.

Even if the input power PL of the hydraulic motor AM is smaller than the first threshold value $\epsilon 1$ in Step S5, the controller C determines in Step S7 whether or not the input power PL is smaller than a second threshold value $\epsilon 2$ after the elapse of the time t1 set beforehand. The first and second threshold values are in a relationship of $\epsilon 1 > \epsilon 2$.

If the input power PL is smaller than the second threshold value $\epsilon 2$ in Step S7, the controller C determines that the input power PL is sufficiently absorbed, returns to Step S3 and executes the normal hybrid control.

However, if the input power PL is larger than the second threshold value $\epsilon 2$ in Step S7, the controller C determines that the input power PL from the boom cylinder BC is not sufficiently absorbed and the present state is an abnormal state, and proceeds to Step S8.

In Step S8, the controller C controls the tilting angle controller 35 to maximize the tilting angle of the assist pump AP and maximize the displacement volume per rotation. Simultaneously, the first and second proportional electromagnetic throttle valves 40, 41 are closed.

By doing so, the boom cylinder BC reliably stops and the abnormal state is canceled.

Although the above embodiment is described, taking a regenerative power control of the boom cylinder BC as an example, the case of controlling regenerative power of the rotation motor RM is the same as in the case of the boom cylinder BC.

That is, in the case of suddenly stopping the rotation motor RM, the control valve 1 is returned to the neutral position and the electromagnetic on-off valve 46 is closed. Since there is a limit to responsiveness of the electromagnetic on-off valve 46 at this time, the input power of the hydraulic motor AM exceeds absorption capacity of the motor generator MG.

Also in this case, the controller C executes a control based on the flow chart shown in FIG. 2 or 3.

The embodiment of the present invention has been described above. The above embodiment is merely illustration of one application example of the present invention and not of the nature to specifically limit the technical scope of the present invention to the above embodiment.

The present application claims a priority based on Japanese Patent Application No. 2010-116604 filed with the Japanese Patent Office on May 20, 2010, all the contents of which are hereby incorporated by reference.

INDUSTRIAL APPLICABILITY

This invention is applicable to hybrid operating machines such as hybrid power shovels.

The invention claimed is:

1. A hybrid operating machine, comprising:

a main pump;

an engine which drives the main pump;

a variable-capacity assist pump connected to a discharge side of the main pump via a joint passage;

a tilting angle controller which controls a tilting angle of the assist pump, a proportional electromagnetic throttle valve provided in the joint passage;

an actuator;

a control valve which controls a supply of pressure fluid from the main pump to the actuator;

a variable-capacity hydraulic motor which is rotated by return oil from the actuator;

a motor generator connected to the assist pump and the hydraulic motor;

a battery connected to the motor generator; and a controller which is connected to the tilting angle controller and the proportional electromagnetic throttle valve, determines whether or not the control valve is at a neutral position, detects input power of the hydraulic motor rotated by the return oil from the actuator and narrows the opening of the proportional electromagnetic throttle valve when the control valve is at the neutral position and the input power of the hydraulic motor is in excess of a first threshold value.

2. The hybrid operating machine according to claim 1, wherein:

the controller narrows the opening of the proportional electromagnetic throttle valve and controls the tilting angle controller to increase the tilting angle of the assist pump when the input power of the hydraulic motor is in excess of the first threshold value.

3. The hybrid operating machine according to claim 1, wherein:

the controller controls the tilting angle controller to maximize the tilting angle of the assist pump and closes the proportional electromagnetic throttle valve when power to the hydraulic motor is in excess of a second threshold value smaller than the first threshold value after an elapse of a set time following the narrowing of the opening of the proportional electromagnetic throttle valve.

4. The hybrid operating machine according to claim 1, wherein in response to the input power being in excess of the first threshold value, the controller controls the proportional electromagnetic throttle valve to narrow the opening of the proportional electromagnetic throttle valve, and controls the tilting angle controller to increase the tilting angle of the assist pump.

5. The hybrid operating machine according to claim 1, wherein the input power is in excess of the first threshold value so that the controller narrows the opening of the proportional electromagnetic throttle valve, and further wherein the controller is responsive to the input power being in excess of a second threshold value, that is smaller than the first threshold value, after an elapse of a set time from the narrowing of the proportional electromagnetic throttle valve, so that the controller controls the tilting angle controller to maximize the tilting angle of the assist pump and closes the opening of the proportional electromagnetic throttle valve.

6. A hybrid operating machine, comprising:

a main pump;

an engine driving the main pump;

a variable-capacity assist pump connected to a discharge side of the main pump via a joint passage;

a tilting angle controller controlling a tilting angle of the assist pump, a proportional electromagnetic throttle valve provided in the joint passage;

an actuator;

a control valve which controls a supply of pressure fluid from the main pump to the actuator;

a variable-capacity hydraulic motor rotated by return oil from the actuator;

a motor generator connected to the assist pump and the hydraulic motor;

a battery connected to the motor generator; and a controller controlling the proportional electromagnetic throttle valve, the controller performing each of determining whether or not the control valve is at a neutral position, detecting input power of the hydraulic motor, and responding to the control valve being at the neutral position and the input power being in excess of a first threshold value by narrowing an opening of the proportional electromagnetic throttle valve.

* * * * *